United States Patent [19]

Yukl

[11] Patent Number: 5,007,638

[45] Date of Patent: Apr. 16, 1991

[54] PITCHBACK DEVICE FOR ATHLETIC PRACTICE

[76] Inventor: Benjamin Yukl, 29308 Eddy Rd., Wickliffe, Ohio 44092

[21] Appl. No.: 15,422

[22] Filed: Feb. 17, 1987

[51] Int. Cl.[5] ..... A63B 69/40

[52] U.S. Cl. ..... 273/26 A; 272/65; 273/395

[58] Field of Search ..... 273/26 A, 395, 407; 272/65; 182/139

[56] References Cited

U.S. PATENT DOCUMENTS

| | | | |
|---|---|---|---|
| 2,944,816 | 7/1960 | Dixon | 273/395 |
| 3,116,809 | 1/1964 | Nissen | 272/65 |
| 3,156,318 | 11/1964 | Sorensen et al. | 272/65 |
| 3,276,544 | 10/1966 | Hall | 272/65 |
| 3,427,026 | 2/1969 | Mahoney | 273/26 A |
| 3,502,330 | 3/1970 | Cheftel | 273/395 |
| 3,836,144 | 9/1974 | Mahoney | 272/65 |
| 4,119,311 | 10/1978 | Jenkins | 272/65 |
| 4,341,379 | 7/1982 | Milligan | 272/65 |
| 4,553,751 | 12/1985 | Ketchun | 273/26 A |

FOREIGN PATENT DOCUMENTS

| | | | |
|---|---|---|---|
| 1316614 | 12/1962 | France | 273/395 |
| 929247 | 6/1963 | United Kingdom | 273/395 |

*Primary Examiner*—Richard C. Pinkham
*Assistant Examiner*—T. Brown
*Attorney, Agent, or Firm*—Woodling, Krost and Rust

[57] ABSTRACT

Apparatus for converting a small trampoline into a ball player's pitchback device for the practice of pitching and fielding. Members fastened to the legs of the trampoline support it on an edge so that its resilient surface is presented at any of various desired angles to the pitcher. The members include a U-shaped supporting member having two parallel legs and a cross leg connecting the two legs at one end thereof. The other free end of each parallel leg is pivoted to a respective first and second trampoline leg. Two brace members are pivoted to a respective third and fourth trampoline leg. The parallel legs are selectively connectible to different locations along a respective brace member to adjust the angle of the trampoline.

4 Claims, 1 Drawing Sheet

PITCHBACK DEVICE FOR ATHLETIC PRACTICE

FIELD OF THE INVENTION

This invention relates to equipment used for the practice of athletic skills. In particular, it relates to "pitchback" devices for practice of softball or hardball pitching and fielding.

BACKGROUND AND SUMMARY OF THE INVENTION

The skills of pitching and catching a ball ordinarily require a considerable amount of practice to perfect. Where a number of players are practicing these skills together a pair may reciprocally throw the ball to each other so that each practices both skills. But if a single player needs to practice, he cannot practice catching a ball unless it is thrown at him by some means, and he cannot easily practice pitching since after each pitch the ball must be retrieved.

To ameliorate this difficulty, devices have been designed which are intended to return a ball thrown at them, back to the approximate vicinity from which the ball was thrown. Some of such pitchback devices are complex and therefore expensive. Others are simpler, having a resilient surface, typically netting, which merely bounces the ball back. A problem with these simpler devices is that the surface is seldom resilient enough to return the ball for a great distance. Another problem is that even such simple devices, being usable for only a single purpose, are inherently uneconomical, especially when a number of them are needed in an athletic program.

My invention solves these problems by providing a means to convert an ordinary small trampoline so that its resilient surface is used for a pitchback device. Such a surface has proven to be superior, in the pitchback mode, to many previous such surfaces currently in use. In addition, the trampoline may be converted easily back to its original use whenever desired, so that it becomes a multipurpose piece of equipment. Thus superior economy results, since the apparatus of my invention, which is used to effect the conversion, is extremely simple to construct and maintain. It is easy for even children to use. Moreover, the angle from the vertical of the resilient surface, and thus the pitchback angle, is easily adjusted.

Accordingly, it is an object of the present invention to provide a new multi-purpose athletic device which may be used either as a trampoline or as a pitchback device.

A further object of my invention is to provide a means by which a trampoline may be converted into an effective pitchback device.

Yet another object of my invention is to provide a pitchback device in which the pitchback angle may be readily adjusted to create a variety of return flight trajectories.

Further objects and a fuller understanding of the invention will be evident from the claims herein and the description to follow of a preferred embodiment of the invention, together with the Figures, in which:

DESCRIPTION OF A PREFERRED EMBODIMENT OF THE INVENTION

Figure 1:
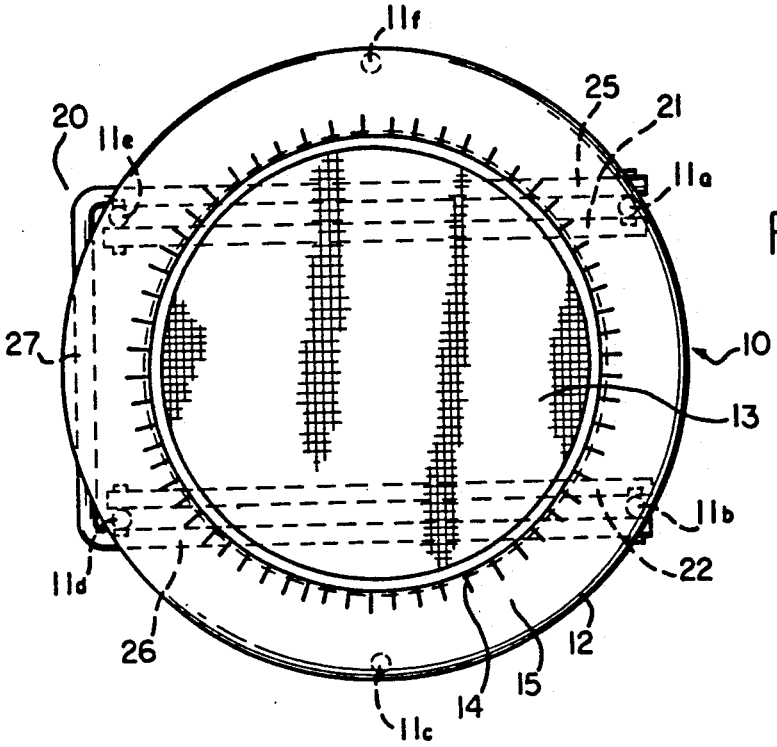
FIG. 1 is a plan view of the preferred embodiment, partly in phantom.

In FIG. 1, a preferred embodiment of my invention is seen from above. A stationary jogging trampoline 10, having a 40 inch diameter was used. Six eight inch long legs 11*a* through 11*f* are spaced at 19.5 inch intervals around its perimeter. The legs 11*a*–11*f* are detachable, being screwed into thread studs welded to a one inch tube 12 which forms the frame supporting the resilient upper surface of the trampoline 10. In this trampoline a 32" diameter web 13 of nylon mesh is attached inside the frame 12 by springs 14 essentially covered by an annular plastic band 15. This is only one of various similar trampolines currently marketed. Others are not round but instead hexagonal or octagonal. It will be readily seen that my invention can be adapted to any such small trampoline having at least four legs spaced so as to be at the corners of a rectangle.

Figure 2:
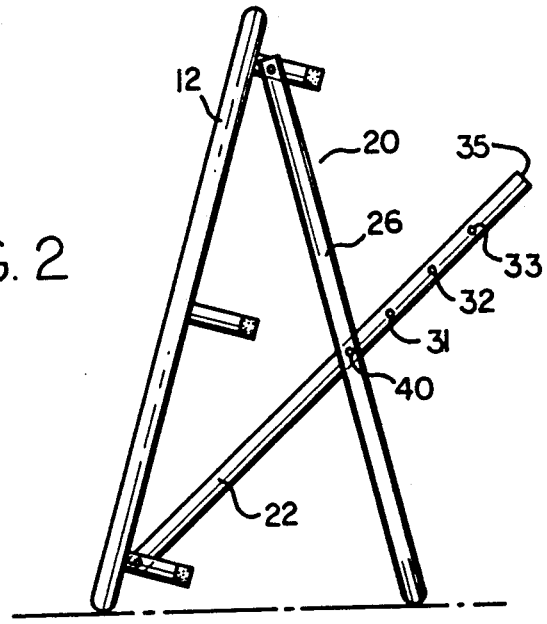
FIG. 2 is a side elevational view of the preferred embodiment shown in a configuration presenting a resilient surface at a first desired angle.
Figure 3:
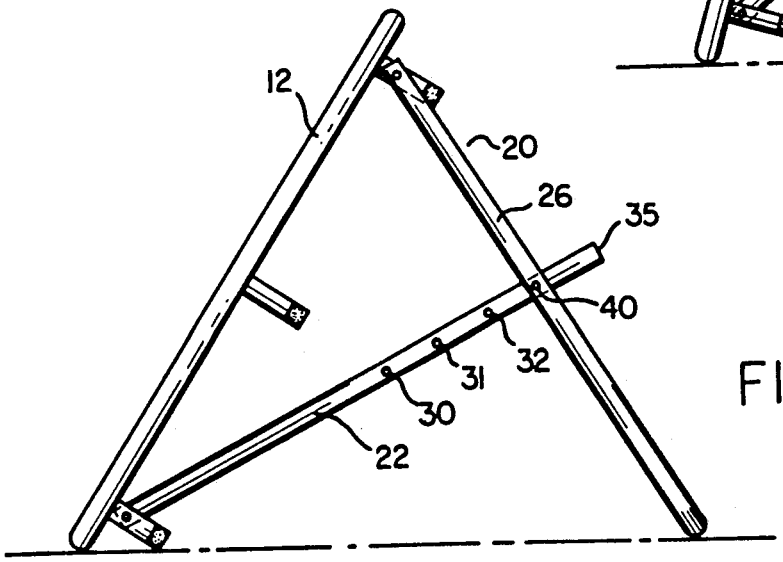
FIG. 3 is a side elevational view of the same embodiment shown in a configuration presenting a resilient surface at a second desired angle.

The newly provided apparatus of the preferred embodiment consists of three members, preferably pieces of pipe. The longest, supporting member 20, is bent into a U-shape having supporting sections 25 and 26 and a connecting section 27 which is preferably straight, for stability. Supporting member 20 is rotatably connected at one end to leg 11*a* and at the other to leg 11*b*. Bolts or any of a number of connecting means, well known to those skilled in the art, may be employed. Legs 11*e* and 11*d*, rectangularly opposite legs 11*a* and 11*b*, have rotatably affixed to them left bracing member 21 and right bracing member 22, respectively. These bracing members are each provided with holes 30, 31, 32 and 33 located at various distances from their free ends 35. Supporting member 20 is also provided with at least one hole 40 on each of its supporting sections 25 and 26, bored in such a direction that a connector such as a bolt may be inserted simultaneously through hole 40 and one of holes 30 through 33 on each side, to connect supporting section 25 to bracing member 21 and supporting section 26 to bracing member 22. It can be seen that one of the bracing members could be eliminated. However two are preferred for stability. The result of such connection is best seen in FIGS. 2 and 3. I prefer to use bolts with wing nuts for ease of assembly and disassembly.

As appears from FIGS. 2 and 3, the angle of the resilient trampoline surface from the vertical is determined by the choice of which of holes 30 through 33 are used to connect supporting member 20 to the bracing members 21 and 22. In the particular embodiment described, the supporting and bracing members are constructed of ¾" conduit. The supporting sections 25 and 26 are 36 inches long; the holes 30 through 33 are about four inches apart. It will be easily seen, however, that for adaptation to a trampoline of other dimensions, the proper positions of the holes on the various members are easily determined by the simple geometry of the apparatus either by calculation or empirically, taking into consideration the dimensions of the trampoline desired to be converted and the desired range of angles of the pitchback device.

Since the members 20, 21 and 22, as seen in FIG. 1, do not cross each other, they may all lie in a single plane. Thus when they are not connected as in FIG. 2 and 3, they rest compactly under the trampoline when it is used for its original purpose. It is necessary therefore, that their mounting to legs 11*a*, 11*b*, 11*e* and 11*d* be located sufficiently far beneath the resilient surface as to prevent the surface from contacting the members as it is urged downward. The necessary clearance will of course be determined by the resiliency of the trampoline and the weight and vigor of its anticipated users.

Hexagonal and octagonal trampolines typically have their legs coincident with their corners. Therefore it is ordinarily no problem to select the mounting legs so that the portion of frame 12 which rests on the ground is a straight section. However, because of straight connecting section 27, the assembly is stable in the pitch-back mode even if the frame rests on a corner.

My invention may be sold as a trampoline having affixed to it the described members and including the necessary fastening hardware. Alternatively, it may be sold as an accessory to one or more already marketed trampolines of similar dimensions.

The invention has been described in detail with particular emphasis on the preferred embodiments thereof, but it should be understood that variations and modifications within the spirit and scope of the invention may occur to those skilled in the art to which the invention pertains.

I claim:

1. In a trampoline comprising a closed, rigid planar frame having a plurality of substantially parallel and equal length frame legs extending therefrom for supporting said frame on a support surface, said frame legs being attached to the perimeter of said frame to form the corners of a rectangular configuration, said planar frame having a resilient material within its perimeter, said material being stretched in the plane of said frame and attached thereto by elastic means to thereby form a rebound surface;

the improvement comprising support means for converting said trampoline to a ball rebound surface, said support means comprising a support member comprising first and second parallel legs and a generally perpendicular cross leg, each of said first and second legs having a first and second end, and said first ends of said first and second legs being joined by said cross leg;

each of said first and second legs having its second end pivotally attached intermediate the ends of a respective frame leg at one end of said rectangular configuration; and at least one elongated brace member having one of its ends pivotally attached to and intermediate the ends of a frame leg at the other end of said rectangular configuration;

said first leg of said support member having attachment means intermediate its ends for attachment of said brace member, said brace member having a plurality of attachment means along the length thereof; said attachment means on said first leg and said brace member cooperating to adjustably orient said planar frame in a plurality of inclined positions relative to a support surface; and said support member and said brace member being pivotable into a substantially common plane beneath said planar frame such that said planar frame will be supported in a substantially horizontal position only by said frame legs.

2. The improvement of claim 1 wherein said support member and said brace member are tubular, said attachment means on said support and brace member being apertures, which when aligned receive a connector for holding said support member and said brace member in a desired position.

3. The improvement of claim 1 and further comprising a second elongated brace member having one of its ends pivotally attached to and intermediate the ends of a second frame leg at the said other end of said rectangular configuration, and in which said second leg of said support member and said second brace member have attachment means cooperating to support said planar frame in any of the same said plurality of inclined positions, and said second brace member is pivotable into the said common plane beneath said planar frame.

4. The improvement of claim 1 and in which said support member is substantially U-shaped.

* * * * *